United States Patent [19]

Severin

[11] Patent Number: 4,921,579

[45] Date of Patent: May 1, 1990

[54] METHOD OF PRE-HEATING A COKE OVEN

[75] Inventor: Norman W. Severin, Lexington, Ky.

[73] Assignee: Hotwork, Inc., Lexington, Ky.

[21] Appl. No.: 726,122

[22] Filed: Apr. 23, 1985

Related U.S. Application Data

[63] Continuation of Ser. No. 474,847, Mar. 14, 1983, abandoned.

[51] Int. Cl.[5] ..... C10B 17/00

[52] U.S. Cl. ..... 201/41; 202/151; 202/270

[58] Field of Search ..... 201/41; 202/151, 270; 432/3, 4, 12

[56] References Cited

U.S. PATENT DOCUMENTS

| | | | |
|---|---|---|---|
| Re. 25,469 | 10/1963 | MacDonnell et al. | 432/4 |
| 3,434,704 | 3/1969 | Ward | 432/4 |
| 3,834,857 | 9/1974 | Hemingway et al. | 431/184 |
| 3,926,543 | 12/1975 | Hemingway et al. | 431/9 |
| 4,000,962 | 1/1977 | Hemingway et al. | 432/4 |
| 4,111,756 | 9/1978 | Lagemann et al. | 201/41 |

FOREIGN PATENT DOCUMENTS

| | | | |
|---|---|---|---|
| 29882 | 6/1981 | European Pat. Off. | 202/151 |
| 65328 | 11/1982 | European Pat. Off. | 202/270 |
| 98582 | 6/1982 | Japan | 201/41 |
| 98586 | 6/1982 | Japan | 201/41 |
| 8102908 | 1/1983 | Netherlands | 202/270 |

*Primary Examiner*—Joye L. Woodard

*Attorney, Agent, or Firm*—Felfe & Lynch

[57] ABSTRACT

A method of heat conditioning a coke oven in a battery circulates hot gas through the oven from a non-radiant burner.

4 Claims, 1 Drawing Sheet

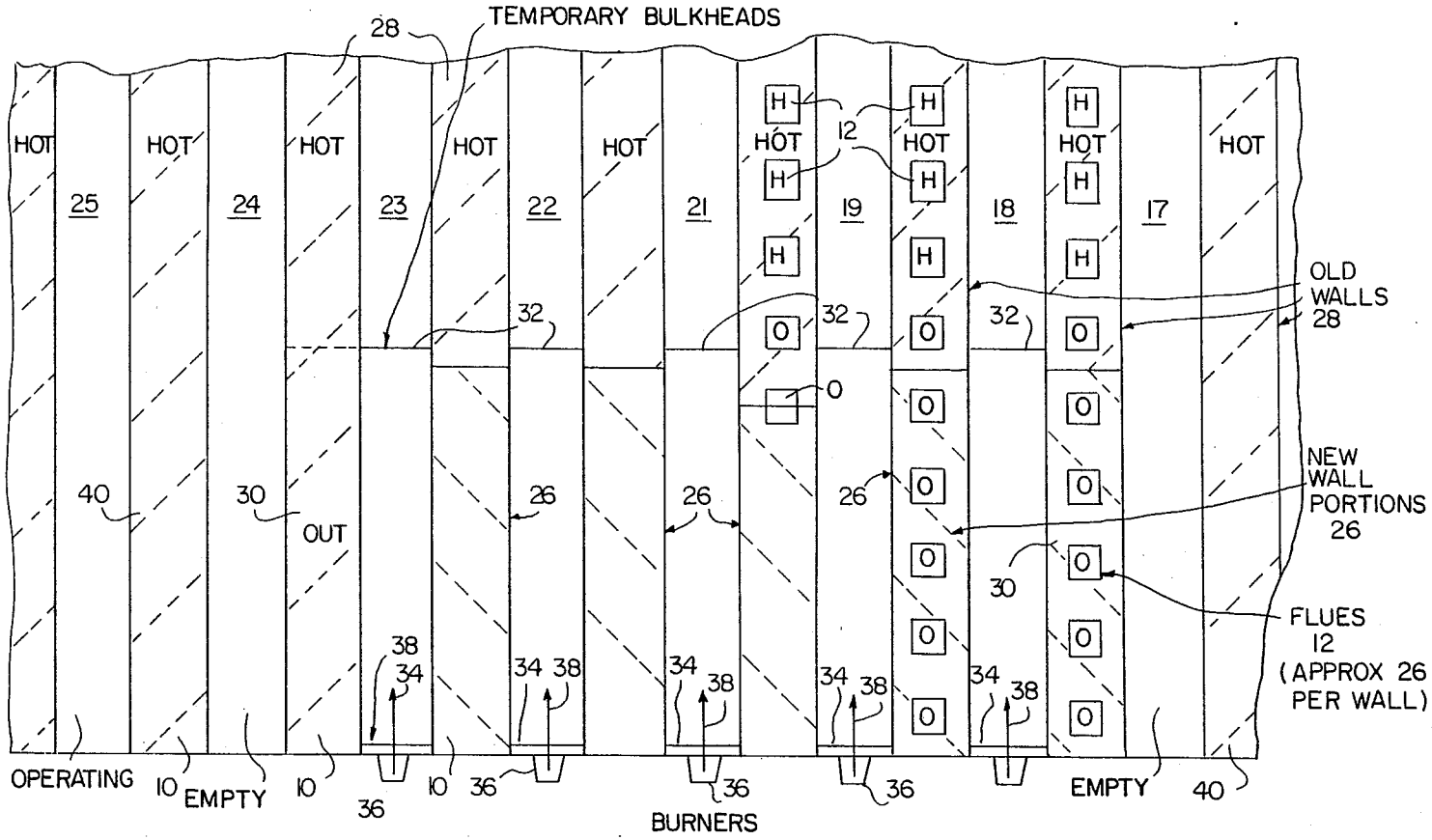
OLD WALLS 28
NEW WALL PORTIONS 26
FLUES 12 (APPROX 26 PER WALL)
TEMPORARY BULKHEADS
HOT
17
18
19
21
22
23
24
25
EMPTY
BURNERS
OUT
OPERATING
10
12
26
28
30
32
34
36
38
40

METHOD OF PRE-HEATING A COKE OVEN

This is a continuation of application Ser. No. 474,847 filed Mar. 14, 1983 and abandoned herewith.

BACKGROUND OF THE INVENTION

The invention relates to a method of heat-conditioning the walls of a coke oven to avoid the thermal-expansion damage thereto.

For many years, coke ovens have been built in enormous batteries of, for example, 25 or more adjacent, tall, narrow ovens. Today, individual ovens may be as large as about 6 meters tall by about 18 meters long by only about 0.5 meters wide. Coal is dumped into the ovens through top charging holes from a Larry car which moves across the top of the battery, for example, and leveled in the oven by a levelling bar which rams across the top of the oven from a pusher car movable along one side of the battery.

The walls separating adjacent ovens have flues spaced within them in which gas burns to heat the ovens to the coking temperature. Flue temperatures of from about 2050° F. to about 2350° F. generally provide satisfactory coking temperatures in the ovens of from about 1900° F. to about 2000° F.

At the coking temperature, volatile material in the coal evolves from the coal to produce the coke. The ovens therefore connect to another duct system to collect the coke oven gas which, after cleaning, may be burnt in the coke oven wall flues or otherwise used.

The oven-wall flues vent via a stack to atmosphere through a device which preheats the combustion air to be burnt in the flues. If the walls of the oven crack, therefore, coke oven gas can escape into the oven-wall flues through which, because it is in excess of the flue to air mixture introduced into the oven-wall flues for burning, it escapes to the atmosphere itself or as products of incomplete combustion in combination with the fuel introduced into the oven-wall flues for burning. Either is a serious pollution problem because of the large size of the ovens.

After the coke has been produced, the opposite ends of the oven are opened and a pusher the size of the oven cross section pushed through the oven from the pusher car pushes the coke out the other side. Pushing the enormous mass of coke, for example 6 meters by 0.5 meters, the length of the oven, for example 18 meters, poses significant risk both from the force of the pusher and the abrasion of the pushed coke of cracking the oven walls sufficiently for coke oven gas to escape into the oven wall flues and atmosphere as pollution when the oven is used again.

The risk of oven wall damage is increased by the high temperature of the oven walls retained between coking operations and the refractory material of the walls required for the coking temperatures. Silica has proved to be the most suitable material, but if it should crack and require repair, or for initial oven heating, its thermal expansion characteristic possess yet another cracking problem.

The thermal expansion characteristic of silica has a high expansion at relatively low temperatures (about 250° F. to about 650° F.) which drops thereafter to almost no expansion above a higher temperature (about 700° F.), the precise expansion characteristic being well-known in material science. If an oven wall cracks or otherwise requires reconstruction, the reconstructed wall is at ambient temperature so that masons can work on its silica brick construction. Then it must be heated to coking temperature without recracking, or warping so that the pusher cannot operate, under thermal expansion from the heating The high expansion gradient at relatively low temperatures makes this very difficult.

The same thermal expansion problem is presented in new batteries or if an entire battery were to be cooled during periods of slack demand for coke and consequent disuse. The seriousness of the expansion problem is emphasized by the resulting practice of keeping entire coke oven batteries above the high temperature of little expansion of the silica for six months or more even though no coke is being produced. The construction of coke oven batteries, the expansion problem in heating them, and the practice of keeping non-productive batteries hot are all described in further detail in U.S. Pat. No. Re. 25,469 reissued Oct. 23, 1963 to MacDonnell et al.

As described in the MacDonnell et al. patent, the only prior solution to the expansion problem in entire coke oven batteries has been very slow cooling and heating over lengthy and thus costly times of from two to three months and often considerably longer. This same, gradual-heating solution has been used for preheating repaired ovens.

The repair of coke oven walls takes one of two forms. One, generally called through-wall repair, is the repair or reconstruction of an oven wall over the entire length of the oven. The other, more common form of repair, generally called end-wall repair, is the repair or reconstruction of just an end portion of an oven wall. (Most often this is the end portion out of which coke is pushed commonly called cokeside, either because these walls are slightly farther apart and thus hotter (about 150° F.) due to the greater volume of coal or because the entire bat of coke abrades them as it is pushed out.)

In either form of repair, the end of the oven adjacent to an end-wall repair or the ends of an oven in through-wall repair are opened and gas burning in all the flues of the wall under repair and generally the two opposite walls stopped so that the ovens adjacent the wall under repair are cool enough to work in. As a result, at least two, but most likely four ovens cannot be used in the repair of one wall, five, for two, six, for three, etc. In combination with the general tendency of the walls to wear at the same rate, this prompts the general practice of repairing walls in groups. When a group of walls is under repair, the two opposite walls in which gas is not burnt are the walls at opposite ends bracketing the group under repair.

The two opposite walls (used herein to mean the walls opposite one or a group of walls under either form of repair) in an operating battery, although unheated by burning gas, are not at ambient temperature. Instead, they are relatively hot because the next adjacent wall is heated by burning gas. As a result, when the ends of the ovens are replaced (sometimes temporarily at first), the ovens between the opposite walls and the repaired wall or walls begin to be heated by the warm, opposite walls before any effective steps are taken to bring the repaired wall or walls up to coking temperature. This heating is sufficient to bring the silica into its range of rapid expansion at low temperatures, particularly at the top of the ovens. The result, therefore, is uncontrolled, uneven heating which can crack, warp, or otherwise expansion damage a newly repaired wall.

If only one wall has been repaired and the ends of the adjacent ovens closed coincidentally, this problem is minimized because the ovens on the opposite sides of the single repaired wall are each heated by the warm opposite walls. The heating, while uncontrolled and uneven, is then at least balanced on opposite sides of the repaired wall and this balance may prevent damage.

An entirely different problem is presented if a group of two or more walls defining at least one oven have been repaired or otherwise brought to ambient temperature. Then, an unheated but warm opposite wall heats only one side of an ambient-temperature wall, the other side facing the other ambient-temperature wall and thus not being heated at all. The heating of the ambient-temperature wall is thus uncontrolled, uneven from top to bottom, and unbalanced from side to side. This poses unreasonable risk of cracking, or warping the wall. A unique problem is therefore presented when at least a portion of more than three successive oven walls are unheated for a time sufficient that the walls defining at least one oven are at ambient-temperature.

When just a portion of a wall is repaired, an end-wall repair, a temporary bulkhead is built across the oven just beyond the portion to be repaired. Gas continues to be burnt in the wall-flues beyond the bulkhead sufficient to keep the walls above ignition temperature of the gas and considerably above the critical expansion of the silica. The bulkhead thus serves to shield the workspace in the oven adjacent the repair from the heat of the remainder of the oven. When the repair is completed, the opened end of the oven which provided access to the repair is temporarily closed and the inner bulkhead may be slowly removed. Heat from the gas-burning flues in the unrepaired section of the wall is conducted to the next flue until it reaches the combustion temperature of the gas. Gas is then introduced into this flue, and ignites to heat the next flue. The process is then repeated, but such a flue-by-flue reignition is very time consuming, the general rule of thumb being about a flue per day. As a result, considerable time is required to reheat and end-wall repair, often in the range of fourteen days or more.

In addition, the progressive pre-heating along the end-wall repair progressively expands the silica and thus stresses the wall and particularly the junction with the already-expanded hot portion of the wall. Bracing between the walls of the oven, particularly at the junction of the repaired and old wall portions is therefore often used. In addition to the cost, the bracing is difficult and dangerous to remove once it is heated with the oven.

The progressive pre-heating also does nothing to correct the side-to-side unbalanced heating of the wall at the end of a group of repairs or the uneven heating, top to bottom, caused by rising heat in the oven as soon as the end of the oven is closed. Indeed, the progressive preheating makes the unevenness worse than that from an adjacent warm wall since the air at the top of the oven gets very hot from the first flues relit long before heat has been conducted to the bottom of the last flues to be relit.

Uneven heating is even more of a problem in through-wall repairs, or in pre-heating an entire battery of ovens. In these operations, there are no hot flues in the wall from which to relight the next flue progressively. A temporarily "Dutch oven" is therefore built in the bottom of each oven adjacent the ends. Gas flames in the "Dutch ovens" then heat the air in the oven until the walls are hot enough to relight their flues. The heat from the ovens rises to heat mostly the top of the oven walls and radiates from the ovens to the adjacent end portions of the oven walls while the bottom of the walls in the middle of the oven remain relatively much cooler. Bracing is therefore often required and, along with the "Dutch ovens", difficult and dangerous to remove from the hot ovens. Even with the bracing, moreover, heating times of from twenty-four to forty-five days are frequently required to pre-heat a through-wall repair and, as already noted, even more time to pre-heat a battery.

The only known prior efforts to scope with uneven heating have been to open the charging holes in the top of the oven or to provide heat-up holes into the flues. Opening the charging holes enough to avoid overheating the top of the oven allows heat to escape as to make even longer the already long pre-heating times. Opening heat-up holes to draw down heat is dependent on the draw of the stack. Moreover, the heat-up holes have to be provided for and later plugged. Both require extra effort, particularly plugging the holes which must be done with long tongs through the charging holes once the oven is hot.

Known techniques of heating refractory lined furnaces or large non-refractory structures use a non-radiating burner delivering a flow of hot gas of the type disclosed, for example, in Hemingway and Ward's U.S. Pat. No. 3,834,857 issued Sept. 10, 1974. Such a burner can circulate enough gas about a relatively much smaller, cold, refractory-lined glass melting furnace to heat it as disclosed in U.S. Pat. No. 3,434,704 issued Mar. 25, 1969 to Ward or U.S. Pat. No. 4,000,962 issued Jan. 4, 1977 to Ward et al. It can also circulate enough gas to heat a large, non-refractory vessel as disclosed in U.S. Pat. No. 3,926,543 issued Dec. 16, 1975 to Hemingway et al. These patents do not even suggest, however, that anything the size of a coke oven battery can be heated to refractory-requiring temperatures. They also do not suggest heating adjacent but separate ovens in such a way as to avoid warping or cracking as may occur if only one side thereof were heated as disclosed in the patents, let alone a regime or heating control therefor. Moreover, none of the patents deals with the problems presented if part of the structure to be heated is already at least warm.

SUMMARY OF THE INVENTION

It is therefore a object of the invention to provide an improved method of heat conditioning at least a portion of a wall of a coke oven.

To this end, the invention provides injecting into each coke oven to have a wall thereof heat conditioned a flow of hot gas from a non-radiating burner at a velocity sufficient to circulate the hot gas throughout the oven. The circulation of hot gas significantly improves the film coefficient of heat transfer between the circulating gas and the oven walls which efficiently and substantially evenly transfers heat into the walls. Then, by controlling the temperature of the hot gas, the oven walls are heated without thermal expansion damage.

In one preferred form of the method, at least a substantially common portion of more than three walls separating adjacent coke ovens of a group of ovens in a battery have been unheated long enough that the walls of at least one oven in the group are at ambient temperature. Hot gas is then injected into each oven having facing unheated walls so that both sides of the walls are heated simultaneously. Cracking and, particularly, warping are avoided in this way.

In another preferred form of the method, one wall of a coke oven is warm and one is unheated and an end of the oven is open. In this form of the method, the warm air is circulated in the oven from a time sufficiently close to enclosing the open end of the oven at least temporarily that damage free pre-heating of the unheated wall is achieved. More specifically, the warm air is circulated to prevent the warm wall from heating the oven in such a way as to damage the unheated wall thereof. This may include, of course, controlling the temperature of the circulating warm air in such a way as to cool the top of the oven while heating the bottom.

DESCRIPTION OF THE DRAWING

Preferred forms of the method which illustrate but do not limit the invention will now be described with reference to the drawing which is a sectioned schematic plan view of a portion of a coke oven battery.

DESCRIPTION OF THE PREFERRED FORMS OF THE METHOD

The drawing shows schematically plan sections of a series of walls 10 in a coke oven battery. Each wall has a series of vertical flues 12 (only some being shown) in which gas normally burns to heat ovens 17, 18, 19, 21, 22, 23, 24, and 25 between the walls.

Substantially common end portions of the walls of a group of ovens 19, 21, and 22 have been repaired or rebuilt as new wall portions 26 in an end-wall repair. The remainder of these walls and the other walls are old or unrepaired walls or wall portions 28. The drawing therefore shows an end wall repair in a group of ovens in the coke oven battery.

Gas burning in the flues of the new wall portions 26 has to be stopped for their repair or reconstruction. Gas burning is usually stopped in the flues of the old wall portions 30 opposite the new walls at the ends of the group to make it possible to work on the other wall of the adjacent ovens 18, 23. For the same reason, gas burning is stopped in the flue of an old wall adjacent its junction with a new wall. These flues are marked O to indicate that the gas is out. The burning gas heats the remaining flues marked H and walls.

Temporary bulkheads 32 are erected across the ovens 18, 19, 21, 22, and 23 at the junction of the old and new walls initially to shield the workers repairing the new walls from the heat of the old walls. The doors of the ovens 18, 19, 21, 22, and 23 are usually removed to provide work access and ventilate the ovens. After completion of the repair, at least temporary bulkheads 34 are built at the ends of these ovens as part of the process for preheating the ovens unless the jambs and operating doors with access holes are in place.

Non-radiant burners 36, for example of the type disclosed in the beforementioned U.S. Pat. No. 3,834,857, inject hot gas through the bulkheads 34 as indicated by the arrows 38 at a velocity sufficient to circulate the hot gas throughout the respective ovens. The circulated hot gas preheats the walls of the ovens between the bulkheads until the flues therein are hot enough to ignite gas introduced into the flues.

The circulation of the gas and precise control of its temperature in burners 36 preheats the walls so evenly across their surfaces, balanced through the walls, and at a rate such that damage to the walls from the thermal expansion of the walls is avoided. More specifically, the old and new walls 26, 28 are preferably made of silica bricks. Silica has high coefficients of expansion at low temperatures and little expansion at higher temperatures. The control of the gas temperature is therefore such as to slowly heat the silica through the range of temperatures in which it rapidly expands and to heat it rapidly outside this range. In this way, rapid heating without expansion damage is achieved. In addition, bracing between the oven walls, even at the junction of the old and new wall portions is not needed.

Usually, the flues in the old wall portions 30 opposite the ends of the group of ovens having new walls 26 are out. These walls are still warm, however, because they are heated by the next adjacent walls 40. The ovens 17, 24 beyond the opposite walls 30 are usually empty; they cannot be used for making coke because the flues in the opposite wall portions have to be out to avoid heating the ovens 18, 23 in which the other wall is being repaired. Heat from the next walls 40 radiates and conducts across the empty ovens 17, 24 to warm the walls 30.

Immediately upon erecting the end bulkheads 34 in the ovens 18, 23 in preparation for pre-heating the walls thereof the space between the bulkheads 32, 34 in ovens 18, 23 starts to heat from the war walls 30. The opposite walls 26 of these ovens are not heated from the sides facing ovens 19, 22. To avoid this unbalanced heating of the walls 30, injecting and circulating only warm air into ovens 18, 23 is started from a time sufficiently close to the completion of the respective bulkheads 34 to avoid thermal expansion damage from the unbalanced heating. This may include cooling at least the top of the walls 30 with the circulating warm air at the same time it is heating the walls 26.

In addition to avoiding bracing and unbalanced heating, the method dramatically reduces the times required for preheating coke ovens. This and the preferred control of the temperature of the gas is indicated in the following Examples:

EXAMPLE I

In an end-wall repair of a group of ovens in a coke oven battery, non-radiant burners circulated hot gas throughout each oven of the group to heat the silica walls thereof substantially uniformly according to the following regimen:

| Temperature Range in °F. | Rate In °F./Hour | Time In Hours |
|---|---|---|
| Ambient to 250 | | 2 |
| about 250–about 650 | about 10 | about 40 |
| 650–850 | 15 | 10 |
| about 850–about 1,200 | about 20 | about 20 |
| 1,200–1,600 | 25 | 16 |

The total preheating time of 88 hours compares most favorably with the prior, flue-by-flue heating of 14 days for a similar end wall repair. No bracing was used, no cracks were noted and the walls remained true.

EXAMPLE II

In a through wall repair along the full length of the silica walls of a group of ovens in a coke oven battery, hot gas was circulated as above according to the following regimen:

| Temperature Range in °F. | Rate In °F./Hour | Time In Hours |
|---|---|---|
| Ambient to 150 | | 2 |
| 150–250 | 10 | 10 |
| 250–650 | 5 | 80 |
| 650–850 | 10 | 20 |
| about 850–about 1,200 | about 15 | about 24 |
| 1,200–1,600 | 20 | 20 |

The walls were in excellent shape (crack free and true) without bracing. The preheating time of less than seven days compares most favorably with prior heat-up times for similar walls from 24 to 45 days.

It will be understood that the method described and claimed for preheating coke ovens also applies as claimed to cooling hot coke ovens, a negative pre-heating. The term heat conditioning includes preheating and cooling down. It will be further understood that the method applies to coke ovens whether used for making coke, incinerating garbage, or other uses to which the structure known as a coke oven battery may be put. It will be further understood that the specific examples of preheating silica coke ovens are exemplary only and further that the method applies to other large silica structures similar to scale and construction to coke oven batteries. Still other variations as may occur to those in the art are contemplated as within the scope of the following claims.

What is claimed:

1. In an operating battery of coke ovens in which at least a substantially common portion of more than three successive walls separating adjacent ovens of a group in the battery are unheated at least for a time sufficient that the unheated walls defining at least one oven of the group reach ambient temperature, a method of heat conditioning the unheated walls of the group of coke ovens, comprising:

at least temporarily enclosing at least substantially so much of each oven of the group as is delimited by facing unheated walls;

injecting into the each oven a flow of hot gas from a non-radiant burner at a velocity sufficient to circulate the hot gas therethroughout; and controlling the temperature of the hot gas such that the walls thereabout are heated without differential thermal expansion damage.

2. The method of claim 1, wherein the walls of each oven are silica and controlling the temperature of the hot gas comprises controlling the same such that the walls of each oven are heated substantially from about 150° F.–250° F. to about 650° F. at from about 5° F./hour to about 10° F./hour and at lower and higher temperatures at higher rates.

3. In a battery of coke ovens in which at least a portion of one wall of one oven is unheated at least for a time sufficient that it reaches substantially ambient temperature and the opposite wall is warm, at least one end of the oven being open, a method of heat conditioning the unheated wall, comprising:

at least temporarily enclosing at least so much of the one oven as is delimited by the ambient-temperature wall portion;

from a time sufficiently close to the completion of the at least temporary enclosure that the temperature of the warm wall has not significantly affected the temperature of the ambient-temperature wall-portion, injecting into the oven a flow of hot gas from a non-radiant burner at a velocity sufficient to circulate the hot gas therethroughout; and controlling the temperature of the hot gas such that the walls thereabout are heated without differential thermal expansion damage.

4. The method of claim 3, wherein the walls of the oven are silica and controlling the temperature of the hot gas comprises controlling the same such that the walls of each oven are heated substantially from about 150° F.–250° F. to about 650° F. at from about 5° F./hour to about 19° F./hour and at lower and higher temperatures at higher rates.

* * * * *